US008429933B2

(12) United States Patent
Howard

(10) Patent No.: US 8,429,933 B2
(45) Date of Patent: Apr. 30, 2013

(54) METHOD FOR VARYING LIQUID PRODUCTION IN AN AIR SEPARATION PLANT WITH USE OF A VARIABLE SPEED TURBOEXPANDER

(75) Inventor: Henry Edward Howard, Grand Island, NY (US)

(73) Assignee: Praxair Technology, Inc., Danbury, CT (US)

( * ) Notice: Subject to any disclaimer, the term of this patent is extended or adjusted under 35 U.S.C. 154(b) by 1546 days.

(21) Appl. No.: 11/939,752

(22) Filed: Nov. 14, 2007

(65) Prior Publication Data

US 2009/0120129 A1 May 14, 2009

(51) Int. Cl.
*F25J 3/00* (2006.01)

(52) U.S. Cl.
USPC ..... 62/649; 62/643; 62/650; 62/656

(58) Field of Classification Search ..... 62/640, 62/643, 644, 648, 649, 651
See application file for complete search history.

(56) References Cited

U.S. PATENT DOCUMENTS

| | | | | |
|---|---|---|---|---|
| 3,217,502 A | | 11/1965 | Keith, Jr. | |
| 3,492,828 A | | 2/1970 | Rückborn | |
| 3,735,599 A | | 5/1973 | Izumichi et al. | |
| 4,566,887 A | * | 1/1986 | Openshaw | 62/652 |
| 4,662,917 A | * | 5/1987 | Cormier et al. | 62/646 |
| 4,696,689 A | | 9/1987 | Mori et al. | |
| 4,966,002 A | * | 10/1990 | Parker et al. | 62/647 |
| 5,144,808 A | | 9/1992 | Ha | |
| 5,437,161 A | * | 8/1995 | Chretien | 62/646 |
| 5,611,218 A | * | 3/1997 | Naumovitz | 62/646 |
| 5,659,205 A | * | 8/1997 | Weisser | 290/52 |
| 5,881,570 A | | 3/1999 | Drnevich et al. | |
| 5,901,579 A | * | 5/1999 | Mahoney et al. | 62/646 |
| 5,924,307 A | * | 7/1999 | Nenov | 62/643 |
| 6,155,076 A | * | 12/2000 | Cullen et al. | 62/606 |
| 6,273,936 B1 | | 8/2001 | Barry et al. | |

FOREIGN PATENT DOCUMENTS

| | | |
|---|---|---|
| EP | 1 020 695 A1 | 7/2000 |
| GB | 2 126 700 A | 3/1984 |
| JP | 1 054187 | 3/1989 |

OTHER PUBLICATIONS

Balje, O. E., "A Study on Design Criteria and Matching of Turbomachines: Part A—Similarity Relations and Design Criteria of Turbines", 1962, pp. 83-102, Journal of Engineering for Power.

* cited by examiner

*Primary Examiner* — John Pettitt
(74) *Attorney, Agent, or Firm* — David M. Rosenblum

(57) ABSTRACT

A method of producing a liquid product stream, for example, a liquid nitrogen product stream, at a production rate that is selectively varied. This variation is produced in either a waste expansion or air expansion process by increasing the pressure and flow rate of the feed stream during periods in which a high rate of liquid production is desired without substantially increasing the pressure of the exhaust stream produced by a variable speed turboexpander. This increases the expansion ratio across the turboexpander and therefore the refrigeration supplied to increase liquid production. At the same time, the increase in flow rate prevents a decrease in the performance of the variable speed turboexpander.

5 Claims, 2 Drawing Sheets

METHOD FOR VARYING LIQUID PRODUCTION IN AN AIR SEPARATION PLANT WITH USE OF A VARIABLE SPEED TURBOEXPANDER

FIELD OF THE INVENTION

The present invention relates to a method of producing a liquid product from a cryogenic rectification process that utilizes a distillation column in which liquid production is varied by adjusting the expansion ratio across a variable speed turboexpander utilized to generate refrigeration for the cryogenic rectification process.

BACKGROUND OF THE INVENTION

Nitrogen is produced by rectifying a nitrogen and oxygen containing gas, typically air, within a distillation column that is used in connection with a cryogenic rectification process. In such processes, the feed stream containing the oxygen and nitrogen is compressed and purified within a purification unit. The compressed and purified stream is then cooled within a main heat exchanger and introduced near the bottom of a distillation column.

Rectification of the feed stream within the distillation column produces a nitrogen-rich column overhead and an oxygen-rich column bottoms. Part of the nitrogen-rich vapor overhead is condensed within a heat exchanger that is operatively associated with the distillation column through indirect heat exchange with a stream of the oxygen-rich column bottoms. The condensation produces a nitrogen-rich liquid stream. A portion of such stream is returned to the column as reflux and another part can be taken as a nitrogen-rich liquid product stream. Additionally, another part of the nitrogen-rich vapor can either be further purified in an additional distillation column or can be directly taken as a product and fully warmed in the main heat exchanger in order to help cool the feed stream to a temperature suitable for its rectification.

The cryogenic rectification process has to be refrigerated in order to offset ambient heat leak, to maintain heat exchanger operation and to produce liquid products. Typically in a nitrogen plant, a stream of oxygen-rich vapor produced by partial vaporization of the stream of the oxygen-rich liquid column bottoms within the heat exchanger used in condensing the nitrogen-rich vapor is partially warmed and then expanded in a turboexpander that can be used to generate shaft work which can be employed to generate electricity. The turboexpansion produces an exhaust stream that is substantially warmed in the main heat exchanger in order to impart refrigeration to the process. Alternatively, air expansion can be used in which the feed air stream is compressed in a base load compressor and optionally a separate booster air compressor. Thereafter, the feed air stream is partially cooled within the main heat exchanger and all or part of the air is introduced into a turboexpander. In such case, refrigeration is imparted by introduction of the exhaust stream from the turboexpander into the distillation column. Another part of the compressed feed air stream can be fully liquefied within the main heat exchanger and also introduced nearer the bottom of the distillation column.

In many instances, it is desirable to produce variable quantities of the liquefied nitrogen both for back up and for merchant export. Additionally, the increasing prevalence of "real time" power pricing is forcing the introduction of increased flexibility into cryogenic rectification plants. In addition, liquid production must often be accomplished while a gaseous product flow is at or near the design rate. To produce variable quantities of liquid product refrigeration production must be varied.

U.S. Pat. No. 3,492,828 discloses a process in which a portion of the product nitrogen stream is compressed in an expander coupled to a booster compressor and recycled to the cold box. A variable amount of nitrogen can be recycled to the cold box and the turbine to vary the refrigeration and hence the liquid production. The disadvantage of such a modification is that it complicates the heat exchanger network, for example, by the requirement that passages be added, and the increased expansion flow rate results in a greater difficulty in maintaining high turboexpansion efficiency. In this regard, radial inflow turbine efficiency can be related to the ratio of volumetric flow rate and the square root of adiabatic head. In general, increasing the flow rate alone will negatively impact turbine efficiency.

A method of varying liquid nitrogen production is disclosed in U.S. Pat. No. 4,566,887. In this patent, a bypass line is used to periodically redirect a portion of the feed air into either a turboexpander that is used to expand the oxygen-rich vapor generated through condensing the nitrogen-rich vapor column overhead. The stream of the oxygen-rich vapor can also be introduced into a separate expander. In such manner, more refrigeration is produced to allow a greater production of the liquid nitrogen product. The problem with this approach is that since part of the feed air is redirected away from the column, during such a redirection, there would be a precipitous decline in gaseous nitrogen production.

As will be discussed, the present invention relates to a method of producing a liquid product by a method in which the expansion ratio across a variable speed turboexpander is varied to adjust the refrigeration and therefore the production of the liquid product while maintaining the turboexpander efficiency essentially constant by varying the flow rate to the variable speed turboexpander. Among other advantages, the present invention allows more variability in the production of product slates than the prior art, for example, the production of both liquid and vapor products.

SUMMARY OF THE INVENTION

The present invention relates to a method of producing a liquid product stream at a production rate that is selectively varied. In accordance with such method, the liquid product stream is produced as a result of a cryogenic rectification process employing a distillation column to separate nitrogen from a feed stream comprising the nitrogen and oxygen that has been compressed, purified and cooled.

In one aspect of the present invention, the cryogenic rectification process utilizes a refrigeration cycle in which an oxygen-rich vapor stream is partially warmed within a main heat exchanger used in cooling the feed stream. The oxygen-rich vapor stream is produced from generation of reflux for the distillation column. At least part of the oxygen-rich vapor stream is expanded within a variable speed turboexpander to generate an exhaust stream that is fully warmed within a main heat exchanger also employed within the cryogenic rectification process to cool the feed stream.

The production rate of the liquid product stream is selectively varied by varying feed stream pressure of the feed stream such that an increase in the feed stream pressure increases an expansion ratio across the variable speed turboexpander and consequently the refrigeration imparted to the cryogenic rectification process, thereby to increase the production rate of the liquid stream and vice-versa. The flow rate of the feed stream is increased during an increase of the feed stream pressure and vice-versa such that efficiency of the variable speed turboexpander remains substantially constant.

During a low production rate of the liquid product stream, a first compressor can be used to compress the feed stream and during a high production rate of the liquid product, the flow rate of the feed stream through the first compressor is increased. The feed stream is thereupon fed from the first compressor into a second compressor configured to increase the feed stream pressure.

In another aspect of the present invention, the cryogenic rectification process employs a refrigeration cycle in which at least part of the feed stream is partially cooled within a main heat exchanger used within the cryogenic rectification process for cooling the feed stream. The at least part of the feed stream is expanded in the variable speed turboexpander to generate an exhaust stream that is introduced into the distillation column.

In this latter aspect of the present invention, the production rate of the liquid product stream is varied by varying feed stream pressure of the feed stream such that increasing the feed stream pressure increases an expansion ratio across the variable speed turboexpander and consequently, the refrigeration imparted to the cryogenic rectification process, thereby to increase the production rate of the liquid product stream and vice-versa. The flow rate of the feed stream is increased during an increase of the feed stream pressure and vice-versa such that efficiency of the variable speed turboexpander remains substantially constant.

The variation of the feed stream pressure and flow rate can be carried out such that during a low production rate of the liquid product stream, the feed stream is compressed with a base load compressor and is further compressed in a booster compressor coupled to the variable speed turboexpander. The booster compressor is a variable speed compressor and during a high production rate of the liquid product stream, the flow rate of the feed stream through the base load compressor is increased so as to increase the speed of the variable speed turboexpander and therefore the speed of the booster compressor and the feed stream pressure.

In either aspect of the present invention, the expansion work can be dissipated by coupling the variable speed turboexpander to a variable speed generator. Further, the liquid product stream can be part of a nitrogen-rich liquid stream also produced in connection with the generation of the reflux for the distillation column. In this regard, the reflux for the distillation column is generated by condensing part of a nitrogen-rich vapor column overhead of the distillation column through indirect heat exchange with a stream of a liquid oxygen-rich column bottoms of the distillation column, thereby partially vaporizing the stream of the oxygen-rich liquid column bottoms to produce residual oxygen-rich liquid and the oxygen-rich vapor stream. Another part of the nitrogen-rich vapor column overhead is discharged as a nitrogen vapor product stream.

In a method of the present invention where the oxygen-rich vapor stream is turboexpanded after having been partially warmed, the stream of the oxygen-rich liquid column bottoms can be subcooled through indirect heat exchange with the oxygen-rich vapor and product nitrogen streams and thereafter valve expanded prior to indirect heat exchange with the part of the nitrogen-rich vapor. The oxygen-rich vapor and product nitrogen streams are then introduced into the main heat exchanger. Within the main heat exchanger the oxygen-rich vapor stream partially warms and the nitrogen vapor product stream fully warms.

In a method in accordance with the aspect of the present invention in which part of the feed stream is expanded, the stream of the oxygen-rich liquid is subcooled through indirect heat exchange with the oxygen-rich vapor stream and the nitrogen product stream and thereafter is expanded by an expansion valve prior to the indirect heat exchange with the part of the nitrogen-rich vapor column overhead. The oxygen-rich vapor stream and the nitrogen product stream after the indirect heat exchange involving the subcooling of the stream of the oxygen-rich liquid are fully warmed within the main heat exchanger. In such aspect of the present invention, part of the feed stream is partially cooled and expanded within the turboexpander and another part of the feed stream is fully cooled and liquefied to produce a liquid feed stream. The liquid feed stream is introduced into the distillation column.

It is to be noted that the term, "variable speed turboexpander" as used herein and in the claims means a turboexpander that is designed to operate at variable speeds and is not coupled to a device in which the expansion work is dissipated in a manner that requires essentially constant rotational speed. Examples of such devices are variable speed generators and direct coupled booster compression wheels. As can be appreciated, a variable speed generator coupled to a variable speed turboexpander is a particularly advantageous combination when used in connection with the present invention. In this regard, the term, "variable speed generator" means a generator that can rotate at variable speeds while maintaining an electrical output at a constant frequency.

In the present invention, a variable speed turboexpander is utilized. The variable speed expander has a very wide range of speed over the prior art and as such, it can accommodate an expansion ratio ranging between 2.5 and 7.0 or more. A conventional fixed speed turboexpander would have only a fraction of this range. In this regard, as used herein and in the claims, the term, "expansion ratio" means a ratio between the inlet and exhaust pressures of the turboexpander.

The greater expansion ratio range of the variable speed expander can be taken advantage of to allow for a wide variation of product slates. For example, it can be used to produce more liquid than a prior art device in an entirely liquid mode of production. Additionally, it can be advantageously used to produce both a gaseous and liquid nitrogen product at the same time with the gaseous production rate being adjusted to meet customer demand. The efficiency of a turboexpander is a function of the volumetric flow divided by the square root of the adiabatic head. The concomitant increase in the flow rate to the variable speed turboexpander in accordance with the present invention allows for such efficiency to be maintained, thereby permitting the variable production slates contemplated by the present invention to be carried out.

BRIEF DESCRIPTION OF THE DRAWINGS

While the present invention concludes with claims distinctly pointing out the subject matter that Applicant regards as his invention, it is believed that the invention will be better understood when taken in connection with the accompanying drawings in which:

The same reference numbers have been used in the drawings for elements that share a common description.

DETAILED DESCRIPTION

Figure 1:
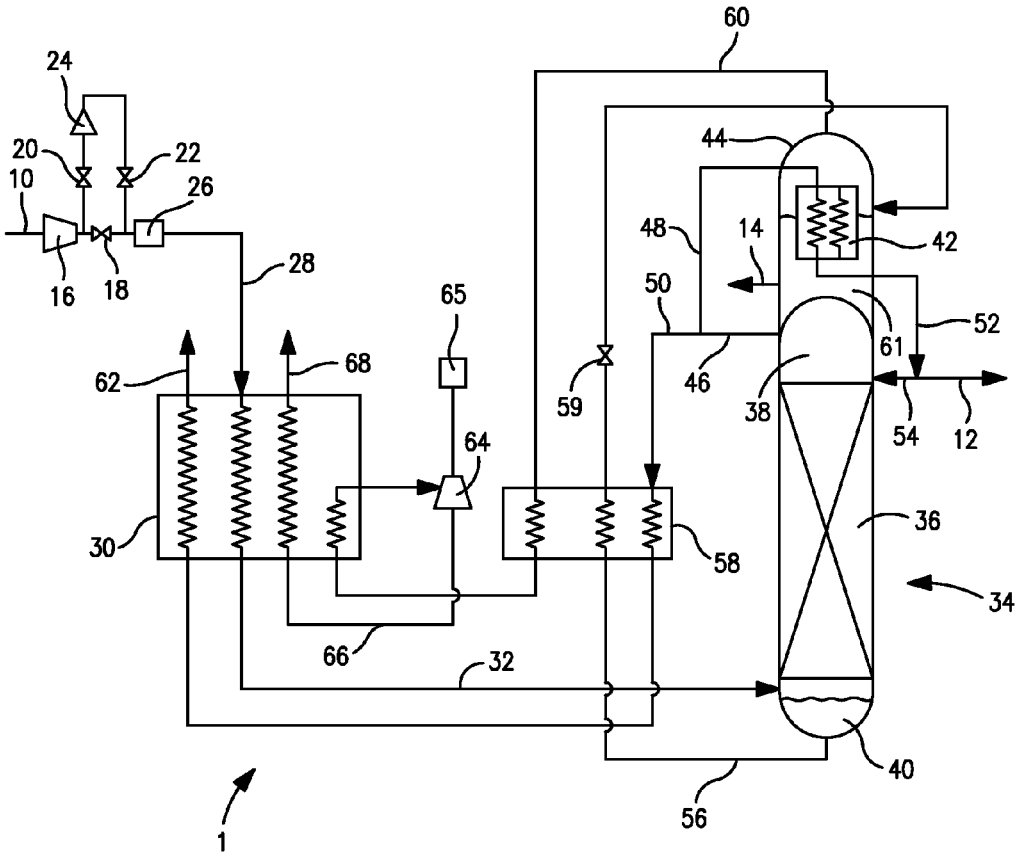
FIG. 1 is a schematic, process flow diagram of an apparatus used in carrying out a method in accordance with the present invention.

With reference to FIG. 1, an air separation plant 1 is illustrated for conducting a cryogenic rectification process in which nitrogen is separated from oxygen that is contained within a feed stream 10, for example air.

The separation produces a liquid product stream that can be a nitrogen-rich liquid product stream 12 or an oxygen-rich liquid product stream 14 or both such product streams. The liquid production rate of the nitrogen-rich liquid product stream 12 or the oxygen-rich liquid product stream 14 or both can be selectively varied in a manner set forth below. It is to be noted that the oxygen-rich liquid product stream 14 is a "product" in so far as it is produced as a result of the separation. Such a stream could be sent to drain, vaporized and vented or alternatively utilized as an oxygen-rich product or further processed to concentrate krypton and xenon components that would be present in such a stream.

During a low production rate of the liquid product, the feed stream 10 is solely compressed within a compressor 16. For such purposes, a valve 18 is set in the open position and valves 20 and 22 are set in the closed position. During periods in which a high rate of production of the liquid product or products is required, valve 18 is closed and valves 20 and 22 are open so that the feed stream 10 is further compressed to a higher pressure within a compressor 24. During periods of high liquid production, the flow rate through compressor 16 is increased to increase the flow rate of feed stream 10. Compressor 16 can be operated such that its pressure output remains constant for both high and low levels of liquid production. For such purposes, compressor 16 is designed with inlet guide vanes that permit adjustment of the flow rate of the feed stream 10 through compressor 16. Alternatively, it is possible to utilize a variable speed compressor which can be adjusted to increase the flow rate and pressure of the feed stream 10.

The compressed feed steam in either the high or low levels of liquid production is then fed into a prepurification unit 26. Prepurification unit 26 typically contains beds of alumina and/or molecular sieve operating in accordance with the temperature or pressure swing adsorption cycle in which moisture and other higher boiling impurities are adsorbed. While one bed is operating another bed is regenerated.

The resultant compressed and purified feed stream 28 is then cooled within a main heat exchanger 30 to a temperature suitable for its rectification and then introduced as a stream 32 into a distillation column 34 that can operate at between about 5 and about 12 bara. Main heat exchanger 30 is typically of aluminum plate-fin construction in which plate-like layers having fins or brazed together that are formed passageways for the various streams to be heated and cooled in indirect heat exchange. Multiple heat exchangers can be used as well known in the art.

Distillation column 34 contains mass transfer contact elements such as generally indicated by reference numeral 36 that can be structured packing, sieve trays, random packing and etc. that are used for bringing vapor and liquid phases of the mixture to be separated into intimate contact with one another to effect the separation. The separation occurring within distillation column 34 produces a nitrogen-rich vapor column overhead that is located within a top region 38 of distillation column 34 and an oxygen-rich liquid column bottoms 40 that is located within a bottom region of the distillation column 34.

As well known in the art, the introduction of stream 32 into distillation column 34 produces an ascending vapor phase that is contacted with a descending liquid phase within mass transfer contacting elements 34. The descending phase is initiated by condensing a part of the nitrogen-rich vapor column overhead within a heat exchanger 42 that can be contained within a shell 44 that is connected to the distillation column 34. As can be appreciated by those skilled in the art, heat exchanger 42 could be located in a separate shell. The heat exchanger can be a thermo-siphon type condenser reboiler or a down-flow heat exchanger that is either constructed in a manner similar to main heat exchanger 30 or can have tubes within a shell.

A nitrogen-rich vapor stream 46 composed of the nitrogen-rich vapor column overhead is divided into a first part 48 and a second part 50 that forms a nitrogen vapor product stream. The first part 48 of the nitrogen-rich stream 46 is introduced into heat exchanger 42 and condensed to form a nitrogen-rich liquid stream 52. Part of the nitrogen-rich liquid stream 52 is taken as nitrogen-rich liquid product stream 12 and a reflux stream 54 is introduced into the top region 38 of distillation column 34 to reflux the column. A stream 56 of the oxygen-rich liquid column bottoms 40 is subcooled within a subcooling unit 58 and then valve expanded within an expansion valve 59. The stream 56 then introduced into heat exchanger 42 in which it substantially vaporizes to form an oxygen-rich vapor stream 60 and a residual oxygen-rich liquid 61. Residual oxygen-rich liquid 61 has a greater concentration of oxygen than steam 56 that has been formed from the oxygen-rich liquid column bottoms 40 due to the partial vaporization thereof in which lighter components will tend to concentrate in the oxygen-rich vapor stream 60. Oxygen-rich liquid product stream 14 can be formed from the residual oxygen-rich liquid 61 and could be further processed and purified as described above.

Both the second part 50 of the nitrogen-rich vapor stream 46 and the oxygen-rich vapor stream 60 pass through the subcooling unit 58 to subcool the stream 56 of the oxygen-rich liquid column bottoms 40. The oxygen-rich vapor stream 60 and the second part 50 of the nitrogen-rich vapor stream 46 are then introduced into the main heat exchanger 30. The second part 50 of the nitrogen-rich vapor stream 46 is discharged as the nitrogen vapor product stream 62 after having been fully warmed within main heat exchanger 30. In this regard, the term, "fully warmed" as used herein and in the claims means warmed to a temperature that is at or near ambient or at the warm end of main heat exchanger 30. The term "fully cooled" as used herein and in the claims means cooled to a temperature at the cold end of main heat exchanger 30. Nitrogen vapor product stream 62 may be subjected to further warm end purification or liquefied as well known in the art.

The oxygen-rich vapor stream 60 is partly warmed within main heat exchanger 30 and then introduced into a variable speed turboexpander 64. The term "partly warmed" or "partly cooled" for that matter as used herein and in the claims means warmed or cooled, respectively, to a temperature intermediate the temperatures at the warm and cold ends of the main heat exchanger 30. Variable speed turboexpander 64 is connected to a variable speed generator 65 that can supply electricity to the grid or can be used in powering compressors 16 and 24. Variable speed turboexpander 64 produces an exhaust stream 66 that is fully warmed within main heat exchanger 30 and discharged as a waste stream 68 that can be used in regenerating the adsorption beds within prepurification unit 26. It is to be noted embodiments of the present invention are possible in which only part of oxygen-rich vapor stream 60 is expanded, the remaining part combined with exhaust stream 66.

The amount of liquid product that is produced, for instance, nitrogen-rich liquid product stream 12 will depend upon the amount of refrigeration that is imparted to the cryogenic rectification plant 1. As the pressure of the compressed and purified feed stream 28 is increased, the operational pressure of distillation column 34 will be increased, as will the pressure of the stream 56 of the oxygen-rich liquid column bottoms 40 and therefore the stream of the oxygen-rich vapor stream 60. Since the passages of main heat exchanger 30 are of finite size, the passage size will act as a flow resistance so that the pressure of exhaust stream 66 will remain substantially constant. At the same time, however, since the pressure of oxygen-rich vapor stream 60 has been increased, the expansion ratio across variable speed turboexpander 64 has been increased and more refrigeration will be imparted.

As indicated above, the efficiency of the variable speed turboexpander 64 is a function of the volumetric flow rate of the oxygen-rich vapor stream 60 divided by the square root of the adiabatic head. However, during periods of high liquid production, since the flow rate of compressed and purified stream 28 has been increased, as has also been described above, the oxygen-rich vapor stream 60 will also have an increased flow rate. Consequently, the expansion ratio increase across variable speed turboexpander 64 will be increased together with an increase in the flow rate so that the efficiency of the variable speed turboexpander 64 is maintained at an essentially constant level.

Since the flow of stream 32 has been increased, the vapor rate within the distillation column 34 will also be increased. What is not appreciated in the prior art, however, is the increase in pressure will also increase the density of the stream 32 to elevate the vapor rate at which the column will flood. Hence, even under such conditions an approach to flooding, that can be anywhere from between about 10 percent and 15 percent of flood, can be maintained as a design point in the operation of the column. As can be appreciated by those skilled in the art, this design point will represent a limitation on the amount the flow rate can be increased within the distillation column 34 in accordance with the present invention. As can also be appreciated, the particular flow rate would depend upon actual column design and size. A further point to be considered is that although the pressure and therefore, the temperature of stream 56 has increased, so too has the pressure and temperature of the first part 48 of the nitrogen-rich vapor stream 46 due to the increase in operational pressure of the distillation column 34. As a result, condensation of the nitrogen-rich vapor is able to take place. Given all of this, the stability of distillation process occurring within distillation column 34 is able to be assured and controlled by means well known to those skilled in the art.

Since the mass flow rate within distillation column 34 is increased, higher production rates of nitrogen liquid product stream 12 can be realized while production rates of the second part 50 of the nitrogen-rich vapor stream 46 that is used in forming nitrogen vapor product stream 62 can be maintained. This is important to prevent the production of the vapor product from decreasing to such an extent that contractual requirements for the air separation plant 1 are violated. As mentioned above, other possible liquid only production slates could be practiced in accordance with the present invention. For example, oxygen-rich liquid product stream 14 could be produced as an option, either as the sole product or in combination with nitrogen-rich liquid product stream 14.

As can be appreciated by those skilled in the art, although nitrogen vapor product stream 62 is taken as a product, there are alternatives. In one known alternative, the second part 50 of the nitrogen-rich vapor stream 46 can be introduced into yet a further distillation column for further treatment and purification of the nitrogen. A yet further option is to take part of the stream 56 of the oxygen-rich liquid column bottoms 40 as a liquid product stream, either as an oxygen enriched product or a product to be further purified.

It is to be further noted, that subcooling unit 58 could be deleted in a possible embodiment of the present invention. In such case, stream 56 of the oxygen-rich liquid would be introduced into heat exchanger 42 by way of valve 59. Alternatively, subcooling unit 58 could be combined with the main heat exchanger 30.

Figure 2:
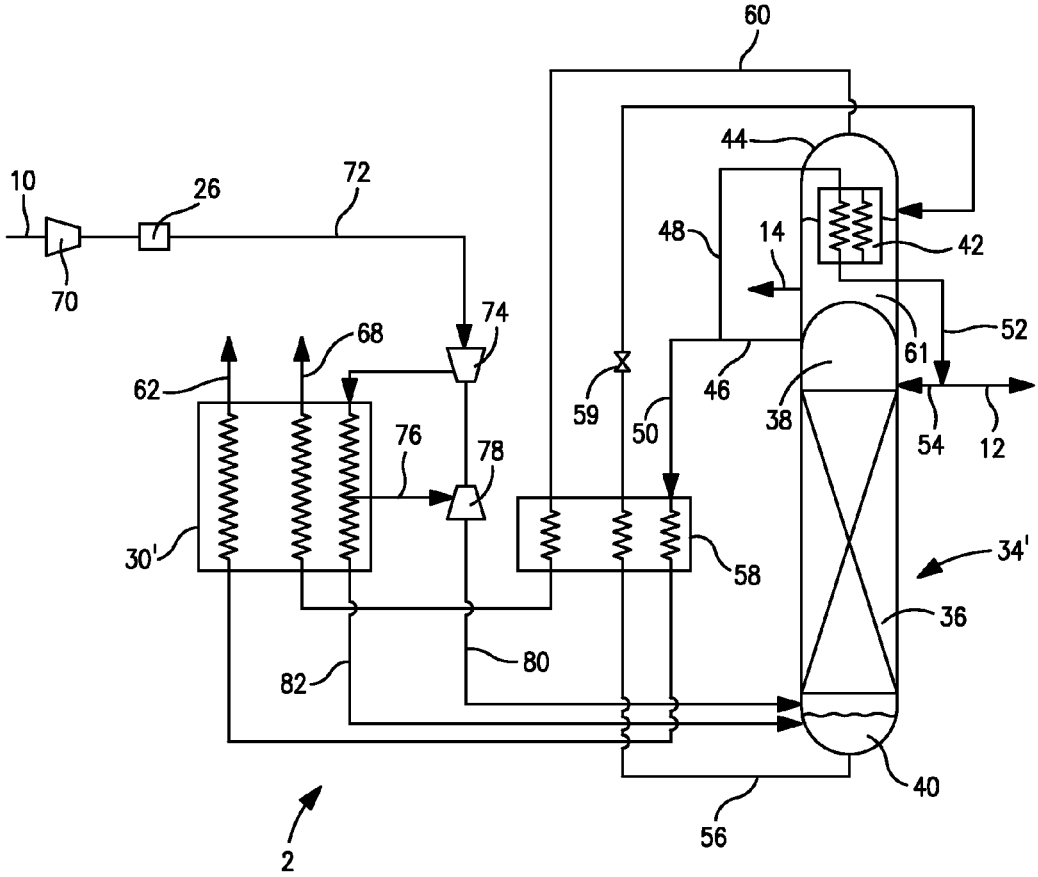
FIG. 2 is a schematic, process flow diagram of an apparatus utilized in carrying out an alternative embodiment of the present invention.

With reference to FIG. 2, an air separation plant 2 is illustrated for conducting a cryogenic rectification process that is used for carrying out a method in accordance with the present invention. This type of plant is known as an air expansion plant in which the incoming air pressure is used for process refrigeration. In this regard, feed stream 10 is compressed by a compressor 70 and introduced into prepurification unit 26 to produce a compressed and purified feed stream 72. Compressed and purified feed stream 72 is then introduced into a booster compressor 74 and then partially cooled between the warm and cold end temperatures of main heat exchanger 30' to produce a stream 76 that is introduced into a variable speed turboexpander 78 mechanically coupled to booster compressor 74. The expansion produces an exhaust stream 80 that is introduced into the distillation column 34 for imparting refrigeration. A second part of the compressed and purified feed stream 72 after having been compressed within booster compressor 74 can be fully cooled within main heat exchanger 30' and in fact, liquefied to produce a liquid air stream 82 that can also be introduced into distillation column 34'. However, this is optional and the entire compressed and purified feed stream 72 compressed by booster compressor 74 could be introduced into variable speed turboexpander 78.

When increased production is required, again, the flow rate through compressor 70 will be increased to increase the flow rate of compressed and purified feed stream 72. Booster compressor 74 and variable speed turboexpander 78 are designed in a manner well know in the art such that the increase in flow rate will cause greater rotational speed within turboexpander 78. As a result, booster compressor 74 will compress the flow to a higher pressure than under lower liquid production makes. This, again, increases the expansion ratio across the variable speed turboexpander 78 to also increase the liquid production.

The expansion ratio increases with pressure because distillation column 34 is also back pressured because the main heat exchanger 30' has passages of only finite size. Therefore the increase in pressure will not increase the pressure within distillation column 34 and the pressure of exhaust stream 80 will be maintained at a substantially constant level. It is to be noted that since oxygen-rich vapor stream is not expanded, it is simply discharged as waste stream 68 as described above in reference to air separation plant 1.

Since the there has been an increase in the flow rate of at least exhaust stream 80 and possibly liquid air stream 82, the vapor rate within distillation column 34 will also increase. During both high and low liquid production levels distillation column 34' operates at essentially constant pressure. As a consequence, column 34' will most likely be designed with a greater diameter so as to accommodate the higher vapor traffic/air feed flow incurred during a high liquid production mode. This of course represents an added expense in carrying out an invention pursuant to the embodiment shown in FIG. 2. As can be appreciated by those skilled in the art, an added disadvantage is that since the column 34' is wider than the column 34, there is less ability to turn down the air separation plant 2 than air separation plant 1.

In the following example, operation of the air separation plant 1 has been simulated at two distinct modes of operation. The conditions for a high and low liquid mode of operation are summarized in the Table below. In each case, the process delivers an equivalent flow of the nitrogen vapor product stream 62. The flow rate of the feed air stream 10 and liquid nitrogen product stream 12 are expressed as ratios relative to the flow rate of the nitrogen vapor product stream 62. Pressures are shown in bara. In the simulation liquid oxygen enriched product stream 14 was not produced.

TABLE

| | Low Liquid Production | High Liquid Production |
|---|---|---|
| Feed Air Flow Ratio [stream 10/stream 62] | 2.189 | 2.824 |
| Liquid $N_2$ Flow Ratio [stream 12/stream 62] | 0.022 | 0.141 |
| Column 34 Pressure | 5.14 | 8.91 |
| Turbine Inlet [stream 60] Pressure | 2.08 | 4.43 |
| Turbine Outlet [stream 66] Pressure | 1.31 | 1.31 |
| Turbine Speed (RPM) | 5632 | 9988 |
| Turbine Specific Speed (Ns) | 77.2 | 74.3 |
| Turbine Specific Diameter (Ds) | 1.40 | 1.52 |

In the above table specific speed is defined as $Ns=RPM*V^{0.5}/\Delta H^{0.75}$, specific diameter is defined as $Ds=D\Delta H^{0.25}/V^{0.5}$ (where D is diameter, RPM is revolutions per minute, ΔH is isentropic head and V is volumetric flow). As can be appreciated, the specific speed and diameter for each point of operation will result in very high turboexpansion efficiency (generally 85 to 90 percent isentropic). As such the process is able to operate effectively in both high and low liquid production modes.

Although both air separation plant 1 and air separation plant 2 have be discussed in relation to methods in accordance with the present invention in which the high and low levels of liquid production are two distinct states, embodiments of the present invention are possible in which intermediate levels of liquid production are realized with the use of variable speed compression equipment to vary flow rates and pressure of the stream being fed to the variable speed turboexpander (oxygen-rich vapor stream 60 and stream 76) at intermediate points.

The invention is applicable to a two-stage rectification having higher and lower pressure columns operatively associated with one another in a heat transfer relationship to produce both oxygen and nitrogen products. The present invention is also applicable to any number of single column options. As an example, distillation column 34 or 34' may employ an auxiliary reboiler for further increasing nitrogen recovery. In such an arrangement, an additional stream of air or nitrogen is compressed to a higher pressure and condensed within the reboiler (thereby providing additional column vapor flow). It is known to adapt air and waste expansion refrigeration to either option. It is also known to operate a nitrogen plant with a multi-stage condenser to improve process recovery. Options in this regard might employ a recycle compressor designed to recirculate a portion of the vaporized oxygen enriched bottoms back to the column system. For such reason, it is important to note that only a portion of the oxygen-rich vapor stream 60 may actually be directed to the variable speed expander (64 or 78).

While the present invention has been described with reference to a preferred embodiment, as will occur to those skilled in the art, numerous changes, additions and omissions can be made without departing from the spirit and the scope of the present invention as set forth in the appended claims.

I claim:

1. A method of producing a liquid product stream at a production rate that is selectively varied, said method comprising:

producing the liquid product stream as a result of a cryogenic rectification process which employs a distillation column for separating nitrogen from a feed stream comprising the nitrogen and oxygen, the feed stream introduced into the distillation column after having been compressed, purified and cooled;

the cryogenic rectification process utilizing a refrigeration cycle that comprises partially warming an oxygen-rich vapor stream within a main heat exchanger used within the cryogenic rectification process for cooling the feed stream, the oxygen-rich vapor stream being produced from the generation of reflux for the distillation column, expanding at least part of the oxygen-rich vapor stream within a variable speed turboexpander to generate an exhaust stream and fully warming the exhaust stream within the main heat exchanger;

selectively varying the production rate of the liquid product stream by varying feed stream pressure of the feed stream such that the increasing feed stream pressure will increase pressure within the distillation column and therefore, the oxygen-rich vapor stream, thereby increasing the expansion ratio across the variable speed turboexpander, the refrigeration imparted to the cryogenic rectification process and consequently, the production rate of the liquid product stream and vice-versa; and increasing flow rate of the feed stream during an increase of the feed stream pressure and thereby producing the oxygen-rich vapor stream at an increased flow rate and vice-versa such that efficiency of the variable speed turboexpander remains substantially constant.

2. The method of claim 1, wherein expansion work is dissipated by coupling the variable speed turboexpander to a variable speed generator.

3. The method of claim 1, wherein during a low production rate of the liquid product stream, a first compressor compresses the feed stream and during a high production rate of the liquid product, the flow rate of the feed stream through the first compressor is increased and the feed stream is fed from the first compressor into a second compressor configured to increase the feed stream pressure.

4. The method of claim 1, wherein the liquid Product stream is part of a nitrogen-rich liquid stream also produced in connection with the generation of reflux to the distillation column.

5. The method of claim 4, wherein:

reflux for the distillation column is generated by condensing part of a nitrogen-rich vapor column overhead of the distillation column through indirect heat exchange with a stream of a liquid oxygen-rich column bottoms of the distillation column, thereby partially vaporizing the stream of the oxygen-rich liquid column bottoms to produce residual oxygen-rich liquid and the oxygen-rich vapor stream;

another part of the nitrogen-rich vapor column overhead is discharged as a nitrogen vapor product stream;

the stream of the oxygen-rich liquid column bottoms is subcooled through indirect heat exchange with the oxygen-rich vapor stream and the nitrogen vapor product stream and thereafter is expanded by an expansion valve prior to the indirect heat exchange with the part of the nitrogen-rich vapor column overhead; and the oxygen-rich vapor stream and the nitrogen vapor product stream after the indirect heat exchange involving the subcooling of the stream of the oxygen-rich liquid are introduced into the main heat exchanger to partially warm the oxygen-rich vapor stream and to fully warm the nitrogen vapor product stream.

* * * * *